US006672194B2

(12) United States Patent
Daoud

(10) Patent No.: US 6,672,194 B2
(45) Date of Patent: Jan. 6, 2004

(54) ENERGETIC-BASED ACTUATOR DEVICE WITH ROTARY PISTON

(75) Inventor: Sami Daoud, Bedford, NH (US)

(73) Assignee: Textron Systems Corporation, Wilmington, MA (US)

( * ) Notice: Subject to any disclaimer, the term of this patent is extended or adjusted under 35 U.S.C. 154(b) by 0 days.

(21) Appl. No.: 09/910,279

(22) Filed: Jul. 19, 2001

(65) Prior Publication Data

US 2003/0029307 A1 Feb. 13, 2003

(51) Int. Cl.[7] ..... F01B 29/08
(52) U.S. Cl. ..... 89/1.14; 60/635; 60/636
(58) Field of Search ..... 60/635, 636; 89/1.11, 89/1.14; 102/430, 439, 444, 464, 466, 501, 502, 524

(56) References Cited

U.S. PATENT DOCUMENTS

| | | | | | |
|---|---|---|---|---|---|
| 887,045 | A | * | 5/1908 | Kock | |
| 944,433 | A | * | 12/1909 | Heilemann | |
| 1,227,134 | A | * | 5/1917 | Koch | |
| 1,318,606 | A | * | 10/1919 | Schneider | |
| 1,417,922 | A | * | 5/1922 | Koch | |
| 1,803,523 | A | * | 5/1931 | Conlon | |
| 1,861,522 | A | * | 6/1932 | Brandt | 102/526 |
| 2,454,818 | A | * | 11/1948 | Lucht | |
| 2,785,632 | A | | 3/1957 | Clauser et al. | |
| 2,975,595 | A | | 3/1961 | Lyons, Jr. et al. | |
| 3,677,132 | A | * | 7/1972 | Plenge | 42/1.14 |
| 3,919,880 | A | * | 11/1975 | Seyd et al. | 138/90 |
| 3,941,057 | A | * | 3/1976 | Peterson et al. | 102/364 |
| 4,005,660 | A | * | 2/1977 | Pichard | 102/501 |
| 4,063,486 | A | * | 12/1977 | Ashley | 102/440 |
| 4,091,621 | A | | 5/1978 | Patrichi | 60/635 |
| 4,145,971 | A | | 3/1979 | Graham et al. | 102/232 |
| 4,187,783 | A | * | 2/1980 | Campoli et al. | 102/520 |
| 4,233,902 | A | * | 11/1980 | Hartley et al. | 102/444 |
| 4,263,807 | A | * | 4/1981 | Brown et al. | 73/167 |
| 4,372,217 | A | * | 2/1983 | Kirkendall et al. | 102/521 |
| 4,439,943 | A | * | 4/1984 | Brakhage | |
| 4,479,320 | A | * | 10/1984 | Fix | 42/70.11 |
| 4,757,766 | A | * | 7/1988 | Ruffle et al. | 102/521 |
| 4,802,415 | A | * | 2/1989 | Clarke et al. | 102/434 |
| 4,850,278 | A | * | 7/1989 | Dinkha et al. | 102/444 |
| 4,854,239 | A | | 8/1989 | Sloun | 102/426 |
| 5,164,538 | A | * | 11/1992 | McClain, III | 102/501 |
| 5,179,234 | A | * | 1/1993 | Cvetanovich | 42/70.11 |
| 5,214,237 | A | * | 5/1993 | McArthur | 102/501 |
| 5,259,319 | A | * | 11/1993 | Dravecky et al. | 102/439 |
| 5,275,107 | A | | 1/1994 | Weber et al. | 102/251 |
| 5,297,492 | A | * | 3/1994 | Buc | 102/521 |
| 5,303,631 | A | | 4/1994 | Frehaut et al. | 89/1.14 |
| 5,309,842 | A | * | 5/1994 | Matysik et al. | 102/430 |

(List continued on next page.)

FOREIGN PATENT DOCUMENTS

| | | | |
|---|---|---|---|
| DE | 199 61 019 C1 | 2/2001 | B60R/21/055 |
| GB | 2 006 877 A | 5/1979 | F15B/15/06 |

OTHER PUBLICATIONS

U.S. SIR H1365, Amspacker et al., Nov. 1994.*

*Primary Examiner*—Michael J. Carone
*Assistant Examiner*—Troy Chambers
(74) *Attorney, Agent, or Firm*—Mills & Onello, LLP

(57) ABSTRACT

A energetic-based piston actuator system imparts a rotational motion in the piston in a manner that increases system efficiency and reliability. A malleable ring mounted about the piston neck obturates upon initiation of the energetic charge, and rifling provided on an interior surface of the actuator barrel causes the ring to rotate, and causes a counter-rotation in the piston. The rotating ring serves as a seal for preventing gas blow-by and the rotating piston is more dynamically stable throughout its travel down the barrel.

23 Claims, 4 Drawing Sheets

U.S. PATENT DOCUMENTS 5,343,649 A * 9/1994 Petrovich
5,565,642 A * 10/1996 Heitz ..... 42/17
5,650,587 A * 7/1997 James
5,716,338 A * 2/1998 Hjertman et al. ..... 604/191
5,894,770 A * 4/1999 Rudkin et al. ..... 82/1.11
5,937,563 A * 8/1999 Schuetz et al. ..... 42/106
6,067,909 A * 5/2000 Knoster, Jr. ..... 102/439
6,085,660 A * 7/2000 Campoli et al. ..... 102/439
6,237,497 B1 * 5/2001 Altenau et al. ..... 102/524
6,295,934 B1 * 10/2001 Tepera et al. ..... 102/525
6,401,622 B1 * 6/2002 Brinkmann ..... 102/524
6,405,472 B1 * 6/2002 Dojcsak ..... 42/70.11
2002/0014076 A1 2/2002 Blackburn et al. ..... 60/508

* cited by examiner

ENERGETIC-BASED ACTUATOR DEVICE WITH ROTARY PISTON

BACKGROUND OF THE INVENTION

Piston actuators are employed to perform mechanical tasks with precise timing and high reliability. A linear piston is slidably mounted within a cylindrical barrel. An energetic pyrotechnic charge, or propellant, is initiated within a sealed chamber to provide a pressure wave, which, in turn, imparts its force on the piston. The piston is propelled through the barrel, and the kinetic energy of the piston is employed by the system to perform mechanical work.

In contemporary designs, the piston is configured to travel in a linear motion through the cylindrical barrel. The barrel has a smooth internal wall of a diameter slightly larger than the diameter of the piston body. Such clearance between the piston and barrel is necessary, in order to allow for resistance-free linear motion of the piston. A consequence of the clearance is referred to in the art as gas "blow-by", whereby a portion of the detonated charge gas escapes through the clearance region past the piston. Thus, the efficiency of the system is compromised. The blow-by gases tend to bounce off the internal front wall of the barrel and retreat back into the front face of the advancing piston, referred to as "piston retraction". This can further compromise the efficiency of the system.

To mitigate the effects of the "blow-by" phenomenon, O-rings have been introduced, in order to improve the seal on the piston, while still permitting piston travel. However, O-rings tend to erode as a result of heat and pressure, and tend to disintegrate under the high pressure of the explosive charge following detonation. Portions of the O-ring can therefore be released into the path of the piston, possibly hindering travel of the piston.

SUMMARY OF THE INVENTION

The present invention is directed to an energetic-based piston actuator system that overcomes the limitations of the contemporary embodiments. In particular, the present invention imparts a rotational motion in the piston in a manner that increases system efficiency and reliability.

In one aspect, the present invention is directed to an energetic-based piston actuator. The actuator includes a barrel having a cylindrical interior surface. A piston is provided in the barrel, the piston being slidable within the barrel and having an outer diameter less than an inner diameter of the interior surface of the barrel. A ring of malleable material is provided about the piston. The interior surface of the barrel includes rifling.

In a preferred embodiment, the rifling engages the ring when the piston is driven in a linear direction down the barrel, the rifling deforming the malleable material of the ring so as to induce a rotational motion in the ring, and a corresponding counter-rotation in the piston.

The piston preferably includes a body and a neck, the piston body having an outer diameter less than the inner diameter of the interior surface of the barrel, and the ring being mounted about the piston neck.

The rifling preferably comprises grooves and lands formed on the interior surface of the barrel. The rifling may be in the form of uniform twist rifling or gain rifling.

The piston may comprise fore and aft piston heads of an outer diameter less than the inner diameter of the barrel cylinder interior surface. In this case, the ring is positioned in a groove between the fore and aft piston heads.

The ring may be mounted rotatable relative to the piston, or alternatively may be fixed to the piston.

An energetic, for example in the form of a propellant or pyrotechnic, when detonated, drives the piston and ring in a longitudinal direction down the barrel. The energetic preferably comprises Bis-Nitro-Cobalt-3-Perchlorate.

In a preferred embodiment, the piston and barrel have a slip-fit relationship.

In another aspect, the present invention is directed to an energetic-based actuator. The actuator includes a barrel having rifling on an interior cylindrical surface. A piston in the barrel has a slip-fit relationship with the barrel, the piston having a longitudinal axis. A ring is mounted about the piston and is rotatable relative to the longitudinal axis of the piston such that when a pressure charge is induced on the piston, the piston is driven down the barrel in an axial direction along the longitudinal axis of the piston, the axial direction of the piston causing the ring to deform in the rifling, causing the ring to mesh with the rifling, and to rotate, as the piston travels in the axial direction.

In this manner, the rotating ring serves as a seal for preventing gas blow-by, and the rotating piston is more dynamically stable throughout its travel down the barrel, leading to improved system efficiency and accuracy.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1:
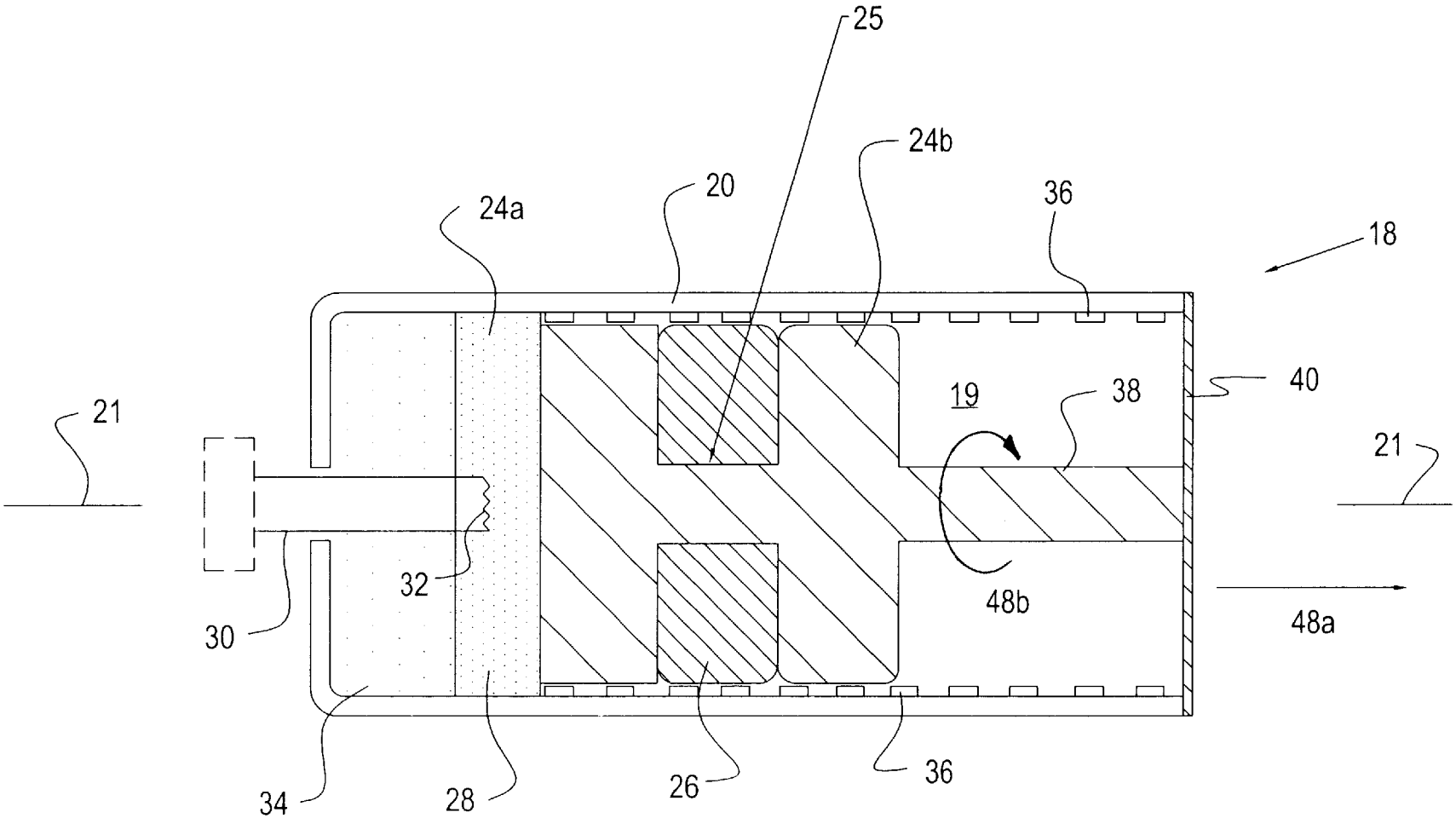
FIG. 1 is a sectional side view of a piston actuator configuration in accordance with the present invention.

With reference to FIG. 1, an embodiment of a piston actuator 18 configured in accordance with the present invention is illustrated. The piston actuator 18 includes a barrel 20 having a cylindrical interior surface 19 and a piston 22 adapted to slide in a longitudinal direction relative to the primary axis of the barrel 20. The piston 22 includes an aft piston head 24*a* at a proximal end and an fore piston head 24*b* spaced apart from the aft piston head 24*a* so as to form a channel or groove 25 therebetween. A distal end of the piston 22 comprises a shaft 38 adapted for mechanically engaging a device to be actuated by the piston actuator 18.

The outer cross-sectional perimeters of the fore and aft piston heads 24*b*, 24*a* are circular in shape and of an outer diameter slightly less than the inner diameter of the inner surface 19 of the barrel 20, for example in a slip-fit relationship. In this manner, the piston 22 slides freely in a longitudinal direction along the concentric longitudinal axes 21 of the barrel 20 and piston 22, without substantially frictionally interfering with the inner surface 19 of the barrel 20. A band 26 of malleable material in the shape of a ring is mounted in the channel 25 between the fore and aft piston heads 24*b*, 24*a* about the piston 22. In a preferred embodiment, the band 26 is circular in shape and concentric with the piston 22 and barrel 20 about axis 21, and rotates freely in the channel 25 about the piston 22. The band 26 serves a number of purposes, discussed in detail below.

The interior surface 19 of the barrel 20 is rifled, for example with rifling grooves 36. An energetic in the form of a pyrotechnic charge or propellant 28 (for the purpose of discussion, the energetic form described herein will be a propellant) is disposed adjacent the outer face of the aft piston head 24*a*. A bridge wire 32 is placed in communication with the propellant 28, and is activated by an electric pulse through lead wires 30 in order to energize the propellant 28. A glass-to-metal seal 34 serves to seal the propellant 28 within the barrel 20. On the opposite, distal, end of the barrel 20, a moisture barrier 40 seals the opposite end of the piston actuator while in a dormant state, thus eliminating possible interaction of moisture with the pyrotechnic during temperature variation or humid atmosphere. A preferred moisture barrier is Parylene; other moisture barrier materials such as polyethylene or polyamid are equally applicable.

When the propellant 28 is energized by an electric charge through the bridge wire 32, the resulting blast imparts a pressure force on the outer face of the aft piston head 24*a*, which drives the piston 22 in a combined outward linear and angular direction as indicated by arrows 48*a* and 48*b*. This initial force exerts enormous pressure on the malleable material of the band 26, causing the band to deform, so as to cause the band's outer perimeter to mesh with the rifling 36 formed on the interior surface 19 of the barrel 20. This, in turn, causes the band to rotate as the band 26 resists the forward linear motion 48*a* of the piston 22. The rotating band 26 obturates the former gap, or clearance, between the outer perimeter of the ring 26 and the rifled inner surface of the barrel 20, thereby serving as a dynamic gas seal for the piston during piston travel, mitigating and/or eliminating the gas blow-by condition. The rotating band 26 further induces a counter-rotation in the piston 22 in a direction or rotation opposite that of the rotation of the band 26. Such counter-rotation occurs because the pressure generated by the released gaseous energy follows a swirl-like pattern, causing the piston 22, which is free to rotate, to start its rotational motion. Dynamic equilibrium must be maintained in the system; therefore, the piston 22 rotates in direction opposite that of the band 26.

Spin induced in the piston 22 stabilizes the travel of the piston and further mitigates the effects of gas blow-by. Due to the free rotation of the piston, gases dissipate their energy by forcing the piston 22 to move in a both axial and rotational directions. Rotation of the piston prevents overpressure in the chamber, which could otherwise lead to blow-by and case rupture. Therefore, the force generated by the gases is dissipated or converted into a kinetic energy imparted by the piston rotation.

In this manner, the present invention provides a piston actuator having enhanced performance consistency and reduced standard deviation. The effects of gas blow-by are mitigated and/or eliminated, as are system failures resulting from O-ring erosion. Performance criteria are determined by angular velocity, which is controlled by the pitch of the rifling, as opposed to linear actuators which rely on force and displacement parameters. In addition, rifling is a mature technology that is well defined, and offers predictable, and reliable, results.

Figure 2A:
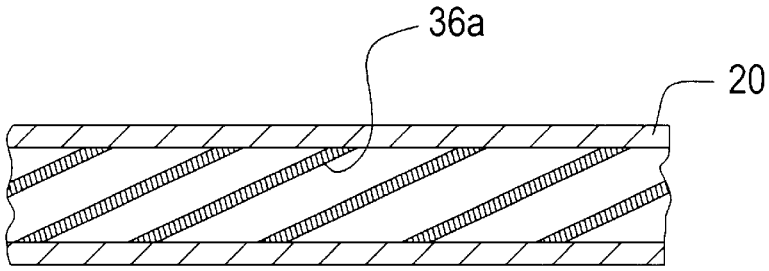
FIGS. 2A and 2B are cutaway side views of the piston actuator cylinder, illustrating uniform-twist and gain-twist rifling, in accordance with the present invention.
Figure 2B:
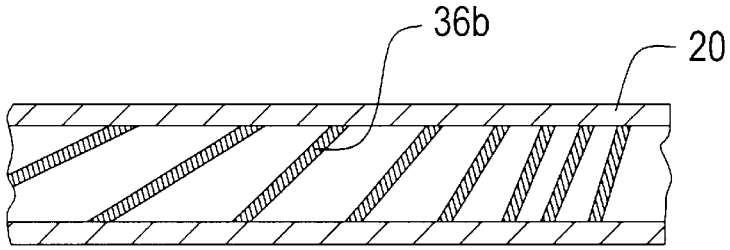

FIGS. 2A and 2B are cutaway side views of the piston barrel 20 illustrating uniform-twist rifling 36*a* and gain-twist rifling 36*b* respectively. With uniform-twist rifling 36*a* as shown in FIG. 2A, the angular acceleration of the piston is proportional to its linear acceleration throughout the piston travel; therefore, the peak value of the angular acceleration occurs at the time of peak pressure. Similarly, the centrifugal acceleration due to piston spin is at a maximum when the piston velocity is at a maximum. Gain-twist rifling as shown in FIG. 2B is useful for those applications requiring a varying kinetic energy in the piston during the piston travel, rather than a constant kinetic energy. The gain-twist rifling 36*b* allows for control over the angular acceleration of the piston 22 throughout its travel through the barrel 20.

Figure 3:
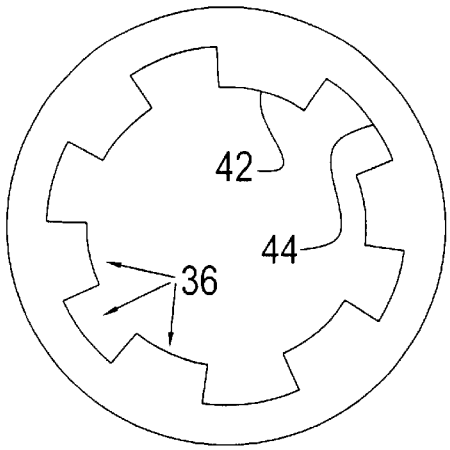
FIG. 3 is a sectional end view of a piston actuator cylinder having rifling, in accordance with the present invention.

FIG. 3 is a sectional end view of a piston actuator barrel including rifling 36. The rifling 36 is formed with grooves 44 and lands 42 of different concentric diameters. The adjustment of the width and depth of the rifling will produce predictable effects for various band materials. As the rotating band is placed under compressive interference stresses, i.e., band pressure, which, with reference to FIG. 6, occurs at the start pressure, the surface of the band is minutely abraded. Consequently, this leads to a reduction in the compressive interference or band pressure. Due to internal rifling of the piston barrel, the rotating band generates a sliding friction during its transition through the barrel. The higher the band pressure, the greater the coefficient of friction; plastic materials create a relatively lower friction than metal materials. Plastic materials also create lower band pressure than metallic materials due to their relative ease in deforming under pressure. Increasing gain, or twist, in the rifling promotes lower band pressure, i.e., lower sliding friction, whereas uniform twist promotes higher band pressure, thus higher sliding friction.

For a rifled piston actuator barrel, other forces associated with the spinning piston are present. The rotating band, i.e. obturating band, follows the twisting grooves in the rifled case, imparting spin to the piston. The angular acceleration of the piston is proportional to the linear acceleration, assuming uniform-twist rifling, so the peak value of this quantity, as well as the peak value of sliding friction, occurs at peak pressure. The centrifugal acceleration, i.e. rotational or angular, acceleration due to piston spin is at a maximum when the piston velocity is at maximum, i.e. when the piston stops at "shot-end" (described below).

The rotating band may comprise, for example, a thermoplastic elastomer based material such as plastic, Teflon, or polyamid, or may comprise a metallic material such as steel, brass, or aluminum. In either case, the band should exhibit a certain degree of malleability.

Figure 4A:
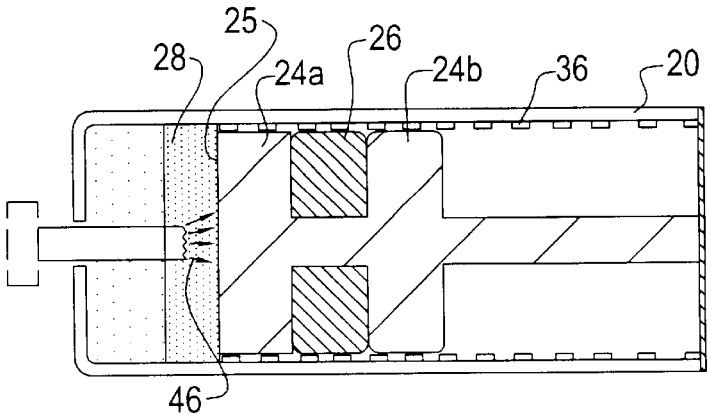
FIGS. 4A–4C are sectional side views of the piston actuator, illustrating propagation of the piston down the cylinder body, in accordance with the present invention.
Figure 4B:
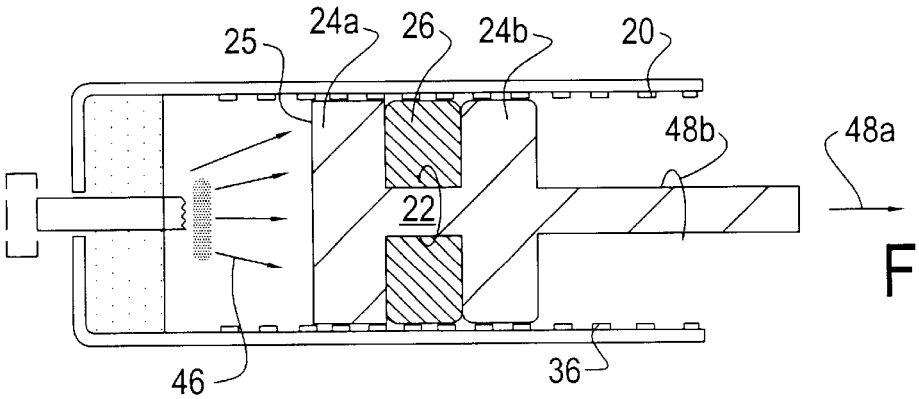
Figure 4C:
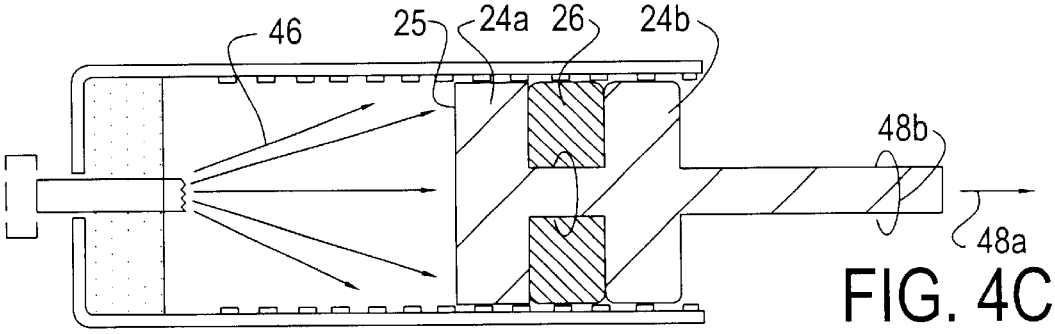

FIGS. 4A–4C are sectional side views of the operation of the piston actuator, illustrating longitudinal propagation of the piston 22 and band 26 through the barrel 20 body. In FIG. 4A, the propellant 28 is initiated, which imparts a charge force 46 on the outer face 25 of the aft piston head 24*a*. This point in time at which the charge beings to exert pressure on the piston 22, causing the piston to begin to move in a forward direction, is referred to herein as the "shot-start"

$S_{START}$ time, while the point in time at which the piston has completed its travel is referred to as the "shot-end" $S_{END}$ time.

Figure 6:
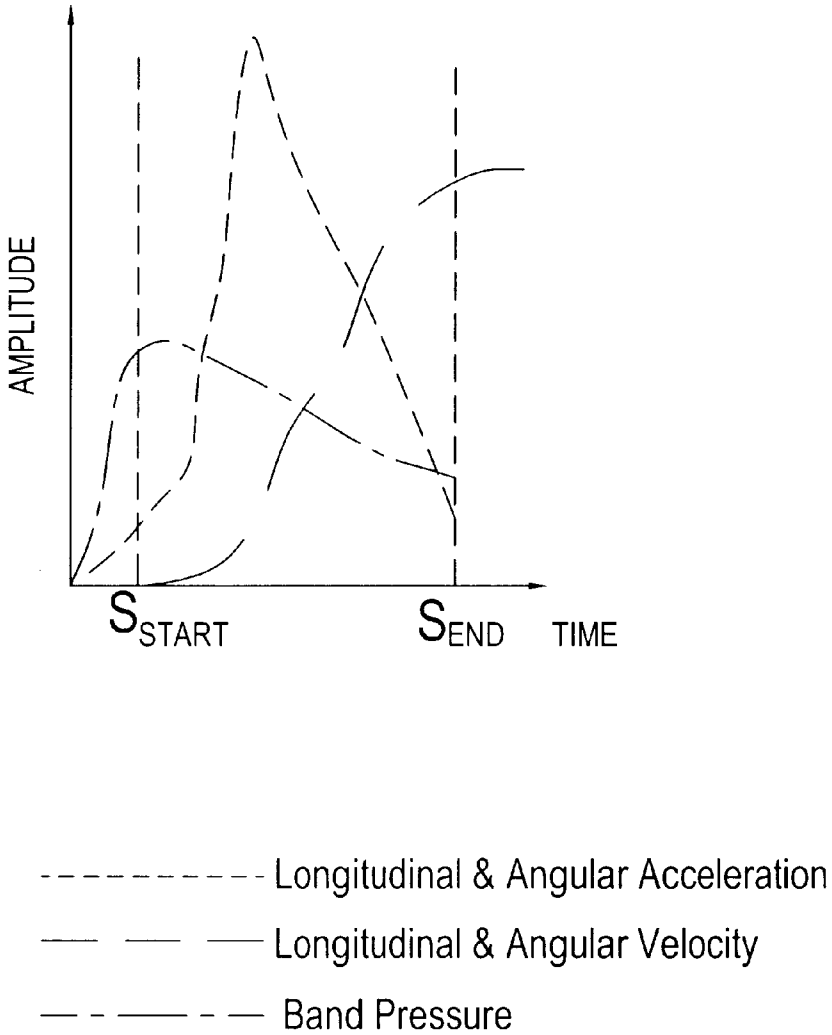
FIG. 6 is a chart of amplitude as a function of time for the parameters of longitudinal and angular acceleration, longitudinal and angular velocity, and band pressure for a piston actuator in accordance with the present invention.

Referring to FIG. 6, which is a chart of the amplitudes of various parameters as functions of time, at the shot-start time $S_{START}$, the band pressure is at a relative maximum, while the longitudinal and angular acceleration of the piston and band are at relative minimums. At the shot-start time $S_{START}$, the obturating band 26 begins to rotate and is placed under compressive interference stresses. Such stresses are generally assumed to be about half of the peak chamber pressure in magnitude when a plastic band is used, and much higher in magnitude when metal bands are employed.

Returning to FIG. 4B, as the piston proceeds longitudinally down the barrel, at increasing velocity, the outer portion of the rotating band 26 becomes minutely abraded as it begins to mesh with the rifling 36, thereby reducing the compression ratio, and thus slightly decreasing the band pressure (see FIG. 6). Coincident with the wear of the band 26 is the sliding friction between the band 26 and the internal rifled surface of the barrel 20, which depends on the band pressure, the appropriate coefficient of sliding fiction, and the band material. For a well-chosen band material, this friction is small compared to the other forces and is generally neglected for structural modeling. This results in marginally higher acceleration of the piston 22. The rotating band 26 follows the twisting grooves in the rifled barrel, thereby imparting spin to the piston 22 in an opposite angular direction. As explained above, the rotational motion of the piston is opposite that of the band, in order to maintain system dynamic equilibrium. With reference to FIG. 4C, the piston velocity and acceleration are greatest when the piston nears the end of its travel at time $S_{END}$.

Eddy currents form during translation of bodies where a fluid is moving at a given velocity behind such bodies. Eddies are, in effect, a result of hydrodynamic phenomena. Eddy formation is dependent on the shape of surfaces and may be reduced by eliminating sharp corners. In many cases, sharp corners and bends may not be totally eliminated, and the need to design bodies with free movement, specifically, angular rotation, will mitigate or eliminate eddy formation. Assuming the piston initially moves solely in an axial direction, high velocity fluid motion, i.e. gas, under high pressure, promotes the formation of eddy currents. This eddy formation becomes more apparent in the presence of sharp bends. By permitting piston rotation, the energy of the moving fluid is quickly dissipated in as it begins to rotate the piston about its axis. The faster the piston rotation, the lower the likelihood of eddy formation, and the less likelihood there is for back pressure to develop and create a blow-by scenario.

Figure 5:
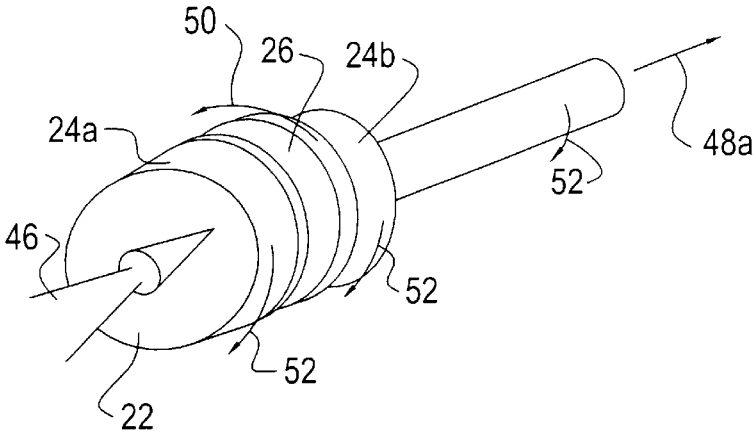
FIG. 5 is a perspective view of the piston and band, illustrating rifling-induced rotational motion of the band, and resulting counter-rotation of the piston, in accordance with the present invention.

FIG. 5 is a perspective view of the piston 22 and band 26 operating under the imparted charge force 46, and moving in a forward angular direction through the barrel as indicated by arrows 48*a*, 48*b*. The band 26 rotates in a first counter clockwise direction 50 which, in turn, causes a counter-rotation of the piston 22 in a clockwise direction indicated by arrows 52.

The angular acceleration of the piston is proportional to the linear acceleration when the barrel is of a uniform-twist rifling, and can vary with respect to the linear acceleration when the barrel is of a gain-twist rifling, as described above. The centrifugal acceleration due to piston spin is at a maximum when the piston velocity is at a maximum, for example at the time of Shot-end $S_{END}$ when the piston stops moving (see FIG. 6).

Other loads can occur transversely or unsymmetrically within the chamber. When the obturating band 26 is aft of the center of gravity of the piston, a slight transverse displacement of this center of gravity away from the central axis of the barrel will create a moment tending to increase the displacement, causing the configuration to become dynamically unstable. This load is minimized by locating the center of gravity of the piston 22 near the rotating band 26.

The piston 22 is preferably formed of a steel material, for example, type 17-4 PH, or alloy steel, type 303. The ring 26 is preferably formed of a malleable material which will tend to obturate under the high pressure exerted by the explosive charge and instant acceleration of the piston, for example plastic or copper.

The pyrotechnic charge 28 preferably comprises Bis-Nitro-Cobalt-3-Perchlorate, a high energy pyrotechnic that is capable of undergoing a deflagration-to-detonation (DDT) transition. A first-order approximation of the pyrotechnic charge weight required may be made by assuming a 90% efficiency level; i.e., the realized mechanical output is 90%, or higher, of the pyrotechnic energy.

$$E_m = 0.90 \text{ ft-lb} \tag{1}$$

where $E_m$ Mechanical Energy, ft-lb; and $E_p$=Pyrotechnic Energy, ft-lb;

The energy content of the pyrotechnic is given by:

$$E_p = FC/(g-1) \text{ ft-lb} \tag{2}$$

where

C=charge weight, lb;

F=pyrotechnic impetus, ft-lb/lb; and g=ratio of specific heats

Equation (2) may also be derived using the Equation of State for the pyrotechnic/propellant gas, i.e., $$PV = 12\ FTC/T_0,\ PSI \tag{3}$$

where

P=Gas pressure, lb/in.$^2$

T=Gas temperature, ° R.

$T_0$=Adiabatic isochoric flame temperature, ° R.

V=Gas volume, in.$^3$

Assuming adiabatic expansion to infinity and assuming the initial gas temperature equal to the adiabatic isochoric flame temperature, then $$Ep = \int_{Vt}^{\infty} PdV = \frac{FC}{\gamma - 1} \tag{4}$$

Assuming typical values for f(BNCP) (f fine, as opposed to C:crude, i.e., non-ball-milled and non-screened), the impetus $F=1.42\times10^5$ fl-lb/lb, and for y, the ratio of specific heat, g=1.2016. Substituting these values into equations (1) and (2) yields the equation for charge weight:

$$C = E_m(g-1)/0.9F \tag{5a}$$

$$C = 1.58\times10^{-6} E_m, \text{lb} \tag{5b}$$

Therefore, the charge weight for a propellant actuated device the charge weight is:

$$C = 6.46\times10^{-3}\times(250/2.2)\times(0.270/12) = 4.03 \text{ mg} \tag{6}$$

For thrusters, piston actuators, and devices where energy is primarily expended in overcoming a resistive force, kinetic energy imparted to the load is insignificant in comparison, therefore, Equation (6) becomes:

$$C = 6.46\times10^3\int_0^S F_r\,dx, \qquad \text{gram} \tag{7}$$

where $F_r$=Resistive force, lb, and

X=Displacement, ft or $$C=6.46\times10^{-3}\overline{F}_r S \text{ grams} \tag{8}$$

where $\overline{F}_r$: Average Resistive Force, lbs

S: Stroke, ft

Calculation of the pyrotechnic charge weight can be determined as follows. For thrust, charge weight is approximated using equation (8) above. Assuming the desired force to be F=250 lb f, and assuming a stroke S=0.270 in.:

$$C=6.46\times10^{-3}\times250\times(0.270/12)=0.0363 \text{ grams}$$

Therefore, C (BNCP)=0.0363 grams or 36.3 milligrams.

The energy balance for the Piston Actuator closed system at time t, may be determined using the first law of thermodynamics:

$$\text{Initial Energy of Gases=Internal Energy of Gases+Losses} \tag{9}$$

The loss term includes work done by, and heat transferred from, the system. Here, it is assumed that by-products of gaseous combustion will undergo no further reaction once produced. Therefore, using average values for specific heats over the temperature range of BNCP reaction, Equation (9) may be written as:

$$\sum_{i,j} m_{ij}C_{v_{ij}}Tf_{ij} + m_sC_{v_s}Tf_s = \left(\sum_{i,j} m_{ij}C_{v_{ij}}Tf_{ij} + m_sC_{v_s}\right)T_{mean} + L \tag{10}$$

Solving equation (10) yields a value for mean temperature:

$$T_{mean} = \frac{\sum_{i,j} m_{ij}C_{v_{ij}}Tf_{ij} + m_sC_{v_s}Tf_s - L}{\left(\sum_{i,j} m_{ij}C_{v_{ij}}Tf_{ij} + m_sC_{v_s}\right)}. \tag{11}$$

Note that the summations are taken over each surface j of every charge element i with the addition of a bridge wire element s, which is assumed to burn out at t=0.

$$\gamma\equiv C_p/C_v$$

$$C_p-C_v=R \tag{12}$$

$$F=RT_f$$

therefore, $$C_v=F/(\gamma-1)T_f \tag{13}$$

Substituting into equation (10):

$$T_{mean} = \frac{\sum_k \frac{F_k m_k}{(\gamma_k-1)} + \frac{F_s m_s}{(\gamma_s-1)} - L}{\sum_k F_k\frac{m_k}{(\gamma_k-1)Tf_k} + \frac{F_s m_s}{(\gamma_s-1)Tf_s}} \tag{14}$$

Which, in the limit, becomes:

$$T_{mean} = \frac{\sum_k \int \frac{F_k m_k}{(\gamma_k-1)}dm_k + \frac{F_s m_s}{(\gamma_s-1)} - L}{\sum_k \int \frac{F_k m_k}{(\gamma_k-1)Tf_k}dm_k + \frac{F_s m_s}{(\gamma_s-1)Tf_s}} \tag{15}$$

and for differential weights of consumed pyrotechnic:

$$T_{mean}(t) = \frac{\sum_k \int \frac{F_k \dot{m}_k}{(\gamma_k-1)}dt + \frac{F_s m_s}{(\gamma_s-1)} - L(t)}{\sum_k \int \frac{F_k \dot{m}_k}{(\gamma_k-1)Tf_k}dt + \frac{F_s m_s}{(\gamma_s-1)Tf_s}} \tag{16}$$

Assuming a covolume correction applied to the ideal gas law, then for gases and mixtures (assuming Noble-Abel gases & mixtures) at time t:

$$P_{mean}\left[V_{free} - \sum_k m_k\eta_k - m_s\eta_s\right] = \left[\sum_k m_kR_k - m_sR_s\right]T_{mean} \tag{17}$$

Using Equation 12:

$$P_{mean} = \frac{T_{mean}\left[\sum_k \frac{F_k m_k}{T_{f_k}} + \frac{F_s m_s}{T_{f_s}}\right]}{V_{free} - \sum_k [m_k\eta_k - m_s\eta_s]} \tag{18}$$

in other words, $$P_{mean} = \frac{T_{mean}\left[\sum_k \int\left(\frac{F_k}{T_{f_k}}\right)dm_k + \frac{F_s m_s}{T_{f_s}}\right]}{V_{free} - \sum_k \int \eta_k dm_k - \eta_s m_s} \tag{19}$$

The pressure gradient in the piston actuator system will now be calculated using Lagrange approximation. Here, it is assumed that the pyrotechnic charge is entirely burned, and therefore, will be treated as a gas, with uniform distribution along the piston case (piston tube). The derivation in a tube-based reference is:

$$z_p\equiv x_p+x_r \tag{20}$$

where $z_p$ represents resistance pressure, $x_p$ represents piston displacement measured from the initial position, and $x_r$ represents piston barrel displacement measured from initial position.

Therefore, for one-dimensional inviscid equations of continuity and momentum (in the z direction for free motion):

$$\delta\rho/\delta t+\delta(\rho v)/\delta z=0 \quad (0\leq z\leq z_p) \tag{21}$$

$$-1/\rho\delta P/\delta z=\delta v/\delta t+\delta v/\delta z \quad (0\leq z\leq z_p) \tag{22}$$

assuming uniformity, i.e. $\delta\rho/\delta z=0$, then, from equation 21:

$$\delta v/\delta z=-1/\rho\delta\rho/\delta t \tag{23}$$

and the boundary conditions are:

$$v(0,t)=0 \quad v(z_p,t)=v_p \equiv \dot{z}_p \tag{24}$$

where $z_p$ and $v_p$ denote position of the piston head and piston velocity. Integrating over z yields the gas velocity distribution, i.e.

$$v(z,t) = z\frac{\dot{z}_p(t)}{z_p(t)} \tag{25}$$

where $\dot{z}_p$ is the first derivative of $z_p$, with respect to time. Substituting Equation 25 into Equation 22 yields $$\delta P/\delta z = -\rho(z/z_p)\ddot{z}_p \tag{26}$$

where $\ddot{z}_p$ is the second derivative of $z_p$, with respect to time.

The all-burnt assumption implies the spatially uniform density:

$$\rho = \frac{\sum C_i/g}{A_b z_p} \tag{27}$$

Since, from Newton's second law, the acceleration of the piston, at any time t, is expressed as:

$$\text{piston acceleration=net force on piston/piston mass} \tag{28a}$$

where the propulsive force is supplied by the pressure of the pyrotechnic/propellant burning gases on the piston head, and the retarding forces are provided by the internal piston barrel resistance against the rotating band/ring, as well as air resistance against the front of the piston head as the air is compressed during piston forward movement down the piston tube. Hence, piston acceleration is expressed as:

$$\ddot{x}_p = \frac{[P_{base} - P_{res} - P_{air}]A_b}{m_p/g} \tag{28b}$$

Therefore, substituting both equations (27) and (28b), into equation (26):

$$\frac{\partial P}{\partial z} = -\frac{z}{z_p}\left[\frac{\sum C_i/g}{A_b/z_p}\right]\frac{[P_{base} - P_{res} - P_{air}]A_b}{m_p/g} \tag{29}$$

so that:

$$P(z,t) = \Psi(t) - \frac{[P_{base} - P_{res} - P_{air}]\sum C_i}{z m_p z_p^2} z^2 \tag{30}$$

The condition $P(0, t)=P_{chamber}$ implies:

$$\Psi(t)=P_{chamber} \tag{31}$$

so the requirement $P(z_p, t)=P_{base}$ forces:

$$P_{chamber} = P_{base} + \frac{1}{2}\frac{\sum C_i}{m_p}[P_{base} - P_{res} - P_{air}] \tag{32}$$

into the definition:

$$P_{mean} = \frac{1}{z_p}\int_0^{z_p} P(z,t)\,dz \tag{33}$$

Equations (30) and (31) are substituted into (33) and integrated, yielding:

$$P_{mean} = P_{chamber} - \frac{1}{6}\frac{\sum C_i}{m_p}[P_{base} - P_{res} - P_{air}] \tag{34}$$

Substituting the value $P_{chamber}$ from equation (32) into equation (34), and rearranging, yields:

$$P_{base} = \frac{3P_{mean} + \frac{\sum C_i}{m_p}[P_{res} + P_{air}]}{3 + \frac{\sum C_i}{m_p}} \tag{35}$$

Therefore, according to the Lagrange model, knowledge of the propellant/pyrotechnic charge-to-piston weight ratio, the mean pressure, and the resistance pressure, is sufficient for calculating the entire pressure gradient during travel of the piston down the piston tube, and, in particular, the desired base and chamber pressures, where the pressure gradient is defined as the pressure slope, i.e., the rate of pressure rise.

While this invention has been particularly shown and described with references to preferred embodiments thereof, it will be understood by those skilled in the art that various changes in form and details may be made herein without departing from the spirit and scope of the invention as defined by the appended claims.

I claim:

1. An energetic-based piston actuator comprising:

a barrel having a cylindrical interior surface;

a piston in the barrel, the piston being slidable within the barrel between an initial position and a final position, the piston having an outer diameter less than an inner diameter of the interior surface of the barrel;

a ring of malleable material about the piston and being rotatable relative to the piston; and rifling on the interior surface of the barrel wherein the rifling engages the ring when the piston is driven in a linear direction down the barrel, the rifling deforming the malleable material of the ring so as to induce a rotational motion in the ring relative to the piston during travel of the piston between the initial position and the final position, the piston being retained by the barrel following travel.

2. The actuator of claim 1 wherein the deformation of the malleable material of the ring further induces a corresponding counter-rotation in the piston.

3. The actuator of claim 1 wherein the piston includes a body and a neck, and wherein the piston body has an outer diameter less than the inner diameter of the interior surface of the barrel, and wherein the ring is mounted about the piston neck.

4. The actuator of claim 1 wherein the rifling comprises grooves and lands formed on the interior surface of the barrel.

5. The actuator of claim 1 wherein the rifling comprises uniform twist rifling.

6. The actuator of claim 1 wherein the rifling comprises gain rifling.

7. The actuator of claim 1 wherein the piston comprises fore and aft piston heads of an outer diameter less than the inner diameter of the barrel cylinder interior surface.

8. The actuator of claim 7 wherein the ring is positioned in a groove between the fore and aft piston heads.

9. The actuator of claim 1 further comprising an energetic, which, when detonated, drives the piston and ring in a longitudinal direction down the barrel.

10. The actuator of claim 9 wherein the energetic comprises Bis-Nitro-Cobalt-3-Perchlorate.

11. The actuator of claim 9 wherein the energetic comprises a propellant or pyrotechnic.

12. The actuator of claim 1 wherein the piston and barrel have a slip-fit relationship.

13. An energetic-based actuator comprising:

a barrel having rifling on an interior cylindrical surface;

a piston in the barrel having a slip-fit relationship with the barrel, the piston having a longitudinal axis; and a ring mounted about the piston and rotatable about the longitudinal axis of the piston;

such that when a pressure charge impinges on the piston, the piston is driven down the barrel in an axial direction along the longitudinal axis of the piston from an initial position to a final position, the axial direction of movement of the piston causing the ring to deform in the rifling, causing the ring to mesh with the rifling and to rotate relative to the piston as the piston travels in the axial direction, between the initial position and the final position, the piston being retained by the barrel following travel.

14. The actuator of claim 13 wherein the piston includes a body and a neck, and wherein the piston body has an outer diameter less than the inner diameter of the interior surface of the barrel, and wherein the ring is mounted about the piston neck.

15. The actuator of claim 13 wherein the rifling comprises grooves and lands formed on the interior surface of the barrel.

16. The actuator of claim 15 wherein the rifling comprises uniform twist rifling.

17. The actuator of claim 15 wherein the rifling comprises gain rifling.

18. The actuator of claim 13 wherein the piston comprises fore and aft piston heads of an outer diameter less than the inner diameter of the barrel cylinder interior surface.

19. The actuator of claim 18 wherein the ring is positioned in a groove between the fore and aft piston heads.

20. The actuator of claim 13 further comprising an energetic, which, when detonated, drives the piston and ring in a longitudinal direction down the barrel.

21. The actuator of claim 20 wherein the energetic comprises Bis-Nitro-Cobalt-3-Perchlorate.

22. The actuator of claim 20 wherein the energetic comprises a propellant or pyrotechnic.

23. The actuator of claim 13 wherein the ring is formed of malleable material.

* * * * *